US008453412B2

(12) United States Patent
Toedte

(10) Patent No.: US 8,453,412 B2
(45) Date of Patent: Jun. 4, 2013

(54) SPRING BOLT HANGER

(76) Inventor: Lynn Toedte, Anacortes, WA (US)

( * ) Notice: Subject to any disclaimer, the term of this patent is extended or adjusted under 35 U.S.C. 154(b) by 0 days.

(21) Appl. No.: 13/462,611

(22) Filed: May 2, 2012

(65) Prior Publication Data

US 2013/0047546 A1 Feb. 28, 2013

Related U.S. Application Data

(60) Provisional application No. 61/527,752, filed on Aug. 26, 2011.

(51) Int. Cl.
*E04B 1/38* (2006.01)

(52) U.S. Cl.
USPC ..... 52/699; 52/166

(58) Field of Classification Search
USPC ..... 52/699, 166, 701, 705; 411/107
See application file for complete search history.

(56) References Cited

U.S. PATENT DOCUMENTS

| | | | | |
|---|---|---|---|---|
| 3,042,161 | A * | 7/1962 | Meyer, Jr. | 52/166 |
| 3,102,708 | A * | 9/1963 | Crain | 410/107 |
| 4,497,152 | A * | 2/1985 | Weissner | 52/709 |
| 4,509,890 | A * | 4/1985 | Hill | 411/337 |
| 4,557,653 | A * | 12/1985 | Hill | 411/337 |
| 5,338,139 | A * | 8/1994 | Swanstrom | 411/353 |
| 5,653,078 | A | 8/1997 | Kies et al. | |
| 6,240,697 | B1 | 6/2001 | Thompson et al. | |

FOREIGN PATENT DOCUMENTS

| | | |
|---|---|---|
| JP | 2001065742 | 3/2001 |
| KR | 200188388 | 4/2000 |
| KR | 20090119130 | 11/2009 |
| KR | 20100103956 | 9/2010 |

OTHER PUBLICATIONS

International Search Report and Written Opinion for PCT/US2012/051179; Jan. 29, 2013.

* cited by examiner

*Primary Examiner* — Branon Painter
(74) *Attorney, Agent, or Firm* — Swanson & Bratschun, LLC

(57) ABSTRACT

A spring bolt hanger comprising a barrel, a bolt positioned within the barrel, a retainer associated with the bolt, and a spring positioned in the barrel between the retainer and a first end of the barrel, said spring configured to bias the bolt away from the first end of the barrel. The spring bolt hanger has two distinct operative configurations. In the retracted configuration the spring bolt hanger has the bolt retracted into the barrel. In the extended configuration the bolt is extended from the barrel and is accessible outside of the concrete surface for use as an attachment point. The spring bolt hanger may be selectively moved between operative configurations. Also disclosed are methods of using a spring bolt hanger to attach an object to a concrete surface.

18 Claims, 14 Drawing Sheets

SPRING BOLT HANGER

RELATED APPLICATIONS

This application claims the benefit under 35 USC section 119 of U.S. provisional application 61/527,752 filed on Aug. 26, 2011 and entitled "Spring Bolt Hanger," the content of which is hereby incorporated by reference in its entirety and for all purposes.

TECHNICAL FIELD

Disclosed embodiments relate generally to bolts and fasteners and more particularly to spring bolt hangar devices, and methods of producing and implementing the same.

BACKGROUND

It can be difficult to attach objects to concrete surfaces such as concrete walls floors, ceilings or other structural surfaces without having to drill holes to insert a concrete anchor, screw, nail, or other fastening device. Even if holes are drilled into concrete, it can be difficult to ensure that the anchor, screw, nail or other fastener remains securely affixed to the concrete structure.

The embodiments disclosed herein are directed toward overcoming one or more of the problems discussed above.

SUMMARY OF THE EMBODIMENTS

One embodiment disclosed herein is a spring bolt hanger comprising a barrel, a bolt positioned within the barrel, a retainer associated with the bolt, and a spring positioned in the barrel between the retainer and a first end of the barrel, said spring configured to bias the bolt away from the first end of the barrel. The retainer may be a circular retainer or a retainer of any other suitable shape. The spring bolt hanger may further include a plurality of first internal stops disposed on an inner surface of the barrel such that the spring is configured to bias the retainer against the plurality of first internal stops when the bolt is positioned in a retracted state.

In selected embodiments, the barrel includes a rod barrel section and a spring barrel section. The rod barrel section typically has a diameter smaller than a diameter of the spring barrel section. The retainer, the plurality of first internal stops, and the spring are typically positioned in the spring barrel section.

A spring bolt hanger of any embodiment will generally have two distinct operative configurations. In the first configuration referred to herein as the retracted configuration or retracted state, the spring bolt hanger has the bolt retracted into the barrel. The retracted state is useful for installation in concrete or as a reset position when the spring bolt hanger is not being used for the attachment of another element to the concrete structure. In the second configuration, referred to herein as the extended configuration or the extended state, the bolt is extended from the barrel and is accessible outside of the concrete surface for use as an attachment point.

Embodiments of the spring bolt hanger may be configured such that the retainer includes a plurality of recesses corresponding to the positions of the first internal stops. Thus, the bolt and retainer may be moved from the retracted state to the extended state by rotation of the bolt such that retainer recesses align with the first internal stops. The exposed end of the bolt may include a receptacle configured to mate with a tool to provide for manual rotation of the bolt.

Embodiments of the spring bolt hanger may further include one or more second internal stops disposed in the spring barrel section, the second internal stops being configured to prevent rotation of the bolt, when the bolt is used, by interlocking with the plurality of recesses on the retainer when the bolt is in the extended state. The second internal stops may be axially aligned with corresponding first internal stops. Alternatively, each first internal stop and the corresponding second internal stop may be defined by opposite ends of a single stop rail.

The spring bolt hanger may also include one or more attachment plates or other structures providing for the spring bolt hanger to be affixed to a concrete form, mold or other structure.

An alternative embodiment includes a method of attaching an object to a concrete surface. The method is initiated by providing one or more spring bolt hangers as described herein. The spring bolt hanger or hangers may then be embedded in concrete or a similar structural matrix such as epoxy resin. As described above, the spring bolt hanger will have a bolt which can be placed into a retracted state or an extended state. Prior to pouring concrete the spring bolt hanger will be placed into the retracted state. The method further includes moving the bolt to the extended state after the concrete has cured and attaching an object to the extended end of the bolt using any suitable fastening mechanism.

Certain embodiments of spring bolt hanger will include one or more attachment plates providing for convenient attachment to conventional concrete forms. Thus, the method may further include attaching the spring bolt hanger to a concrete form with the attachment plate; and pouring fluid concrete into a space defined in part by the concrete form thus embedding the spring bolt hanger in a structure such as a wall.

As detailed herein, a spring bolt hanger is resettable. Thus the bolt end may be returned to the retracted position if no longer needed for attachment purposes. The method may thus further include removing the object from the bolt; pushing the bolt into the barrel, thus compressing the spring with the retainer; and causing the bolt to be held in the retracted position.

The disclosed spring bolt hanger embodiments and methods thus eliminate the need for drilling concrete structures to insert typical threaded hangers. This saves time and money. The various embodiments of the spring bolt hanger may be installed horizontally or vertically or at an angle between horizontal and vertical. Any size of housings and bolt may be fabricated depending upon anticipated shear or tension loads. Moreover, because of the integration of the spring bolt hanger within the concrete wall (or other concrete surfaces), substantially greater strength is achieved compared to conventional drilled and threaded anchors, hangers or bolts, especially when large loads are required.

DETAILED DESCRIPTION

Unless otherwise indicated, all numbers expressing quantities of ingredients, dimensions reaction conditions and so forth used in the specification and claims are to be understood as being modified in all instances by the term "about."

In this application and the claims, the use of the singular includes the plural unless specifically stated otherwise. In addition, use of "or" means "and/or" unless stated otherwise. Moreover, the use of the term "including," as well as other forms, such as "includes" and "included," is not limiting. Also, terms such as "element" or "component" encompass both elements and components comprising one unit and elements and components that comprise more than one unit unless specifically stated otherwise.

Figure 1:
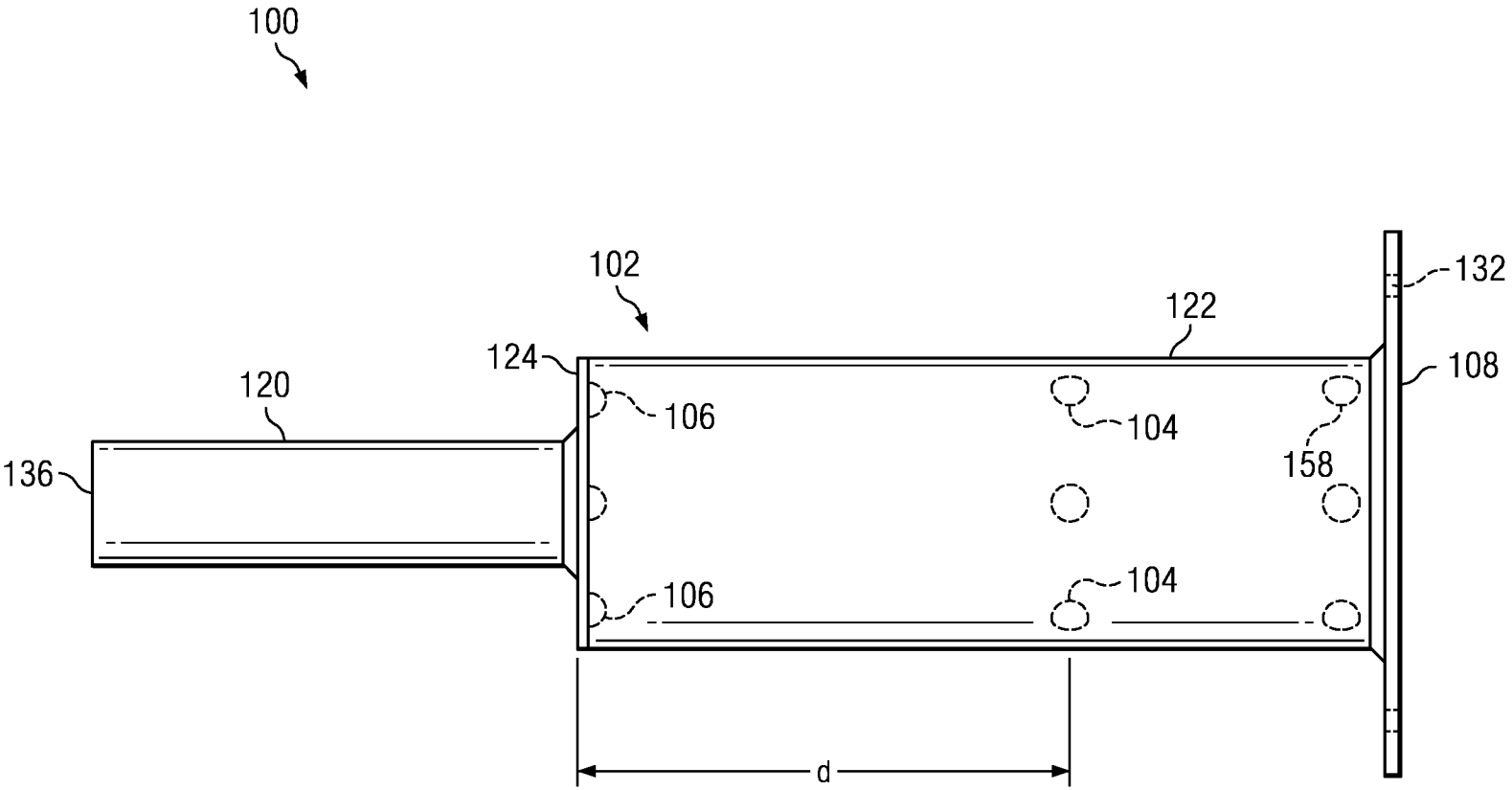
FIG. 1 is a front elevation view of a spring bolt hanger device.
Figure 2:
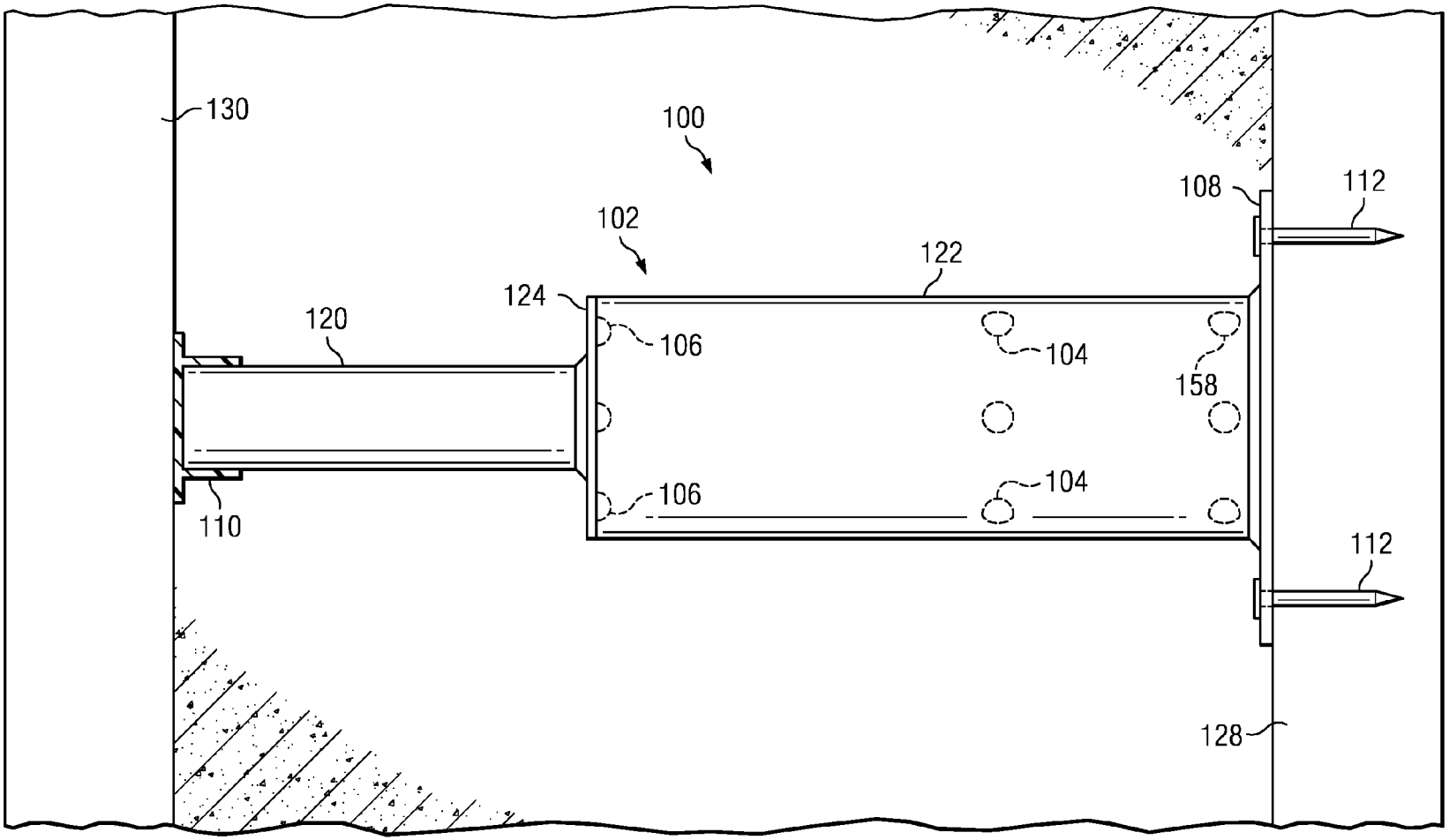
FIG. 2 illustrates the spring bolt hanger device of FIG. 1 embedded within concrete and between front and back concrete forms.
Figure 3:
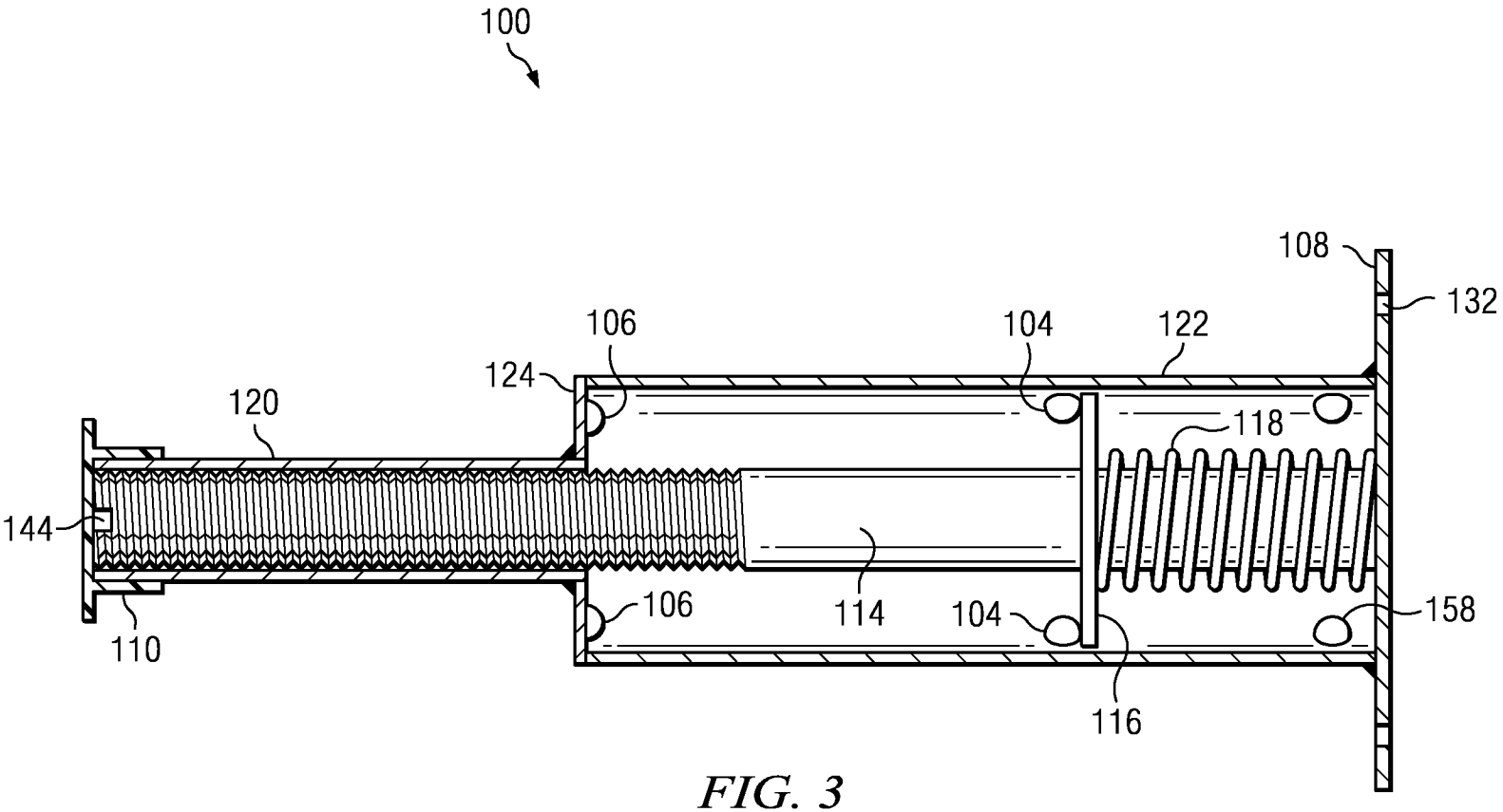
FIG. 3 is a cross sectional view of the spring bolt hanger device of FIG. 1 with the bolt in a first, retracted state.

With reference to FIGS. 1-3, one embodiment of a spring bolt hanger 100 comprises a barrel 102, one or more first internal stops 104, one or more second internal stops 106, a back plate 108, an optional front end cap 110, a bolt 114, a retainer 116 associated with the bolt 114, and a spring 118. The retainer 116 may be associated with the bolt in any manner provided the retainer and bolt may rotate as a unit. In the illustrated embodiments, many elements of the spring bolt hanger, the bolt, retainer and barrel for example, have a circular cross section. Other cross sectional shapes are possible and within the scope of this disclosure.

The barrel 102 includes a smaller diameter rod barrel 120 and a larger diameter spring barrel 122. The spring barrel 122 joins the rod barrel 120 at a junction or surface which may be a plate 124, a machined junction or other transition or any other type of connection between the spring barrel 120 and rod barrel 122. A back plate 108 is located at the end of the spring barrel 122 opposite the rod barrel 120. The back plate 108 can be a plate that is welded on to or otherwise attached to the spring barrel 122 or the back plate could be machined or molded in conjunction with the spring barrel 122.

The first internal stops 104 are bumps, guides, extensions, depressions, bolts or screws or other suitable structures arranged on an inner circumference of the spring barrel 122 at a distance d from the rod barrel end. One nonexclusive method of calculating the distance d is to determine the length of the bolt 114 from a front bolt end 126 to the retainer 116, such that when the spring bolt hanger 100 is configured in a retracted state as described in detail below, the first internal stops 104 abut the retainer 116 at a position that provides for the front bolt end 126 to be fully retracted within rod barrel 120.

The second internal stops 106 are typically, but not exclusively, structures similar to the first internal stops 104. Each of the second internal stops 106 can be arranged to align with each of the first internal stops 104 along an axis parallel with a central, longitudinal axis of the barrel 102. In alternative embodiments, a track or rail may be disposed on or formed in the inner surface of spring barrel 102 along an axis parallel with the central axis between each first internal stop 104 and each second internal stop 106. In other embodiments, each first internal stop 104 and corresponding second internal stop 106 may be formed as a single track or rail with the distinction between first and second stops being defined only by the left and right ends of a retainer track. In yet other embodiments, a retainer track or rail may be formed by creating an indentation or groove extending from the external surface of spring barrel 122 to the inner surface of spring barrel 122 along an axis parallel to the central axis, extending approximately from the near the connection plate 124 or other junction toward the back plate 108 at least a distance d.

FIG. 2 shows the spring bolt hanger 100 affixed to a concrete form 128 by fasteners 112 placed through holes 132 provided in the back plate 108. The use of nails as fasteners 112 to attach the spring bolt hanger 100 to a concrete form provides certain advantages. In particular, the use of nails facilitates the efficient removal of the forms when desired. It is important to note that other attachment devices including but not limited to screws, bolts or adhesives could be used to attach the back plate 108 to a concrete form 128. In addition, alternative embodiments of spring bolt hanger could be placed into a reusable or single use concrete mold or more complex form such as might be used to cast concrete tanks, pipes, pre-stressed concrete structures or other articles of manufacture. Spring bolt hanger embodiments configured for use with a mold might have alternative attachment mechanisms or no attachment plate or mechanism. Furthermore, it should be noted that the spring bolt hanger embodiments disclosed herein could be embedded in a material other than concrete including but not limited to epoxy resin, plastic, plaster or similar materials.

In the embodiment illustrated in FIG. 2, the concrete form 128 is positioned as a "back" concrete form. A front concrete form 130 may also be positioned as shown in FIG. 2 to define the exterior dimensions of a desired concrete structure, a wall for example. The front concrete form 130 also serves to sandwich the spring bolt hanger 100 in an operative position between the forms 130 and 128. When wet concrete is poured between the forms in any conventional manner, a concrete structure is created which embeds the spring bolt hanger 100 in the concrete wall. For certain concrete structures, other styles or types of concrete forms may be used to encase the concrete and hanger, as necessary. The end cap 110 is removable and serves to keep wet concrete from entering the interior of a spring bolt hanger 100 during installation, or to cover the open end of the spring bolt hanger if the bolt is moved to a retracted state as described in detail below.

The plate 108, 124 and barrel 120, 122 components of a spring bolt hanger 100 may be fabricated from bar and tubing stock of suitable dimensions with adjacent elements welded or otherwise bonded together. Alternatively, the barrel and plate structures of the spring bolt hanger 100 could be cast or molded in one or more sub-assemblies or machined from suitable stock. A spring bolt hanger 100 may be fabricated having any suitable dimensions to meet specific needs.

A spring bolt hanger of any embodiment will generally have two distinct operative configurations. In the first configuration (see FIGS. 1-4), referred to herein as the retracted configuration or retracted state, the spring bolt hanger 100 has the bolt 114 retracted into the barrel 102. The retracted state is useful for installation in concrete or as a reset position when the spring bolt hanger is not being used for the attachment of another element to the concrete structure. In the second configuration, (see FIG. 5), referred to herein as the extended configuration or the extended state, the bolt 114 is extended from the barrel 102 and is accessible for use as an attachment point.

FIG. 3 in particular shows the internal apparatus of a spring bolt hanger 100 with the bolt 114 configured for installation or when the bolt is reset and not being actively used. In this configuration the bolt is wholly contained within the barrel 102, with the front bolt end 126 positioned within rod barrel 120. In this configuration the retainer 116 affixed to the bolt 114 is positioned between the first internal stops 104 and the back plate 108. The spring 118 is thus compressed between the retainer 116 and back plate 108. In the FIG. 3 retracted configuration, spring 118 biases the retainer 116 against the first internal stops 104 as described in detail below.

Figure 5:
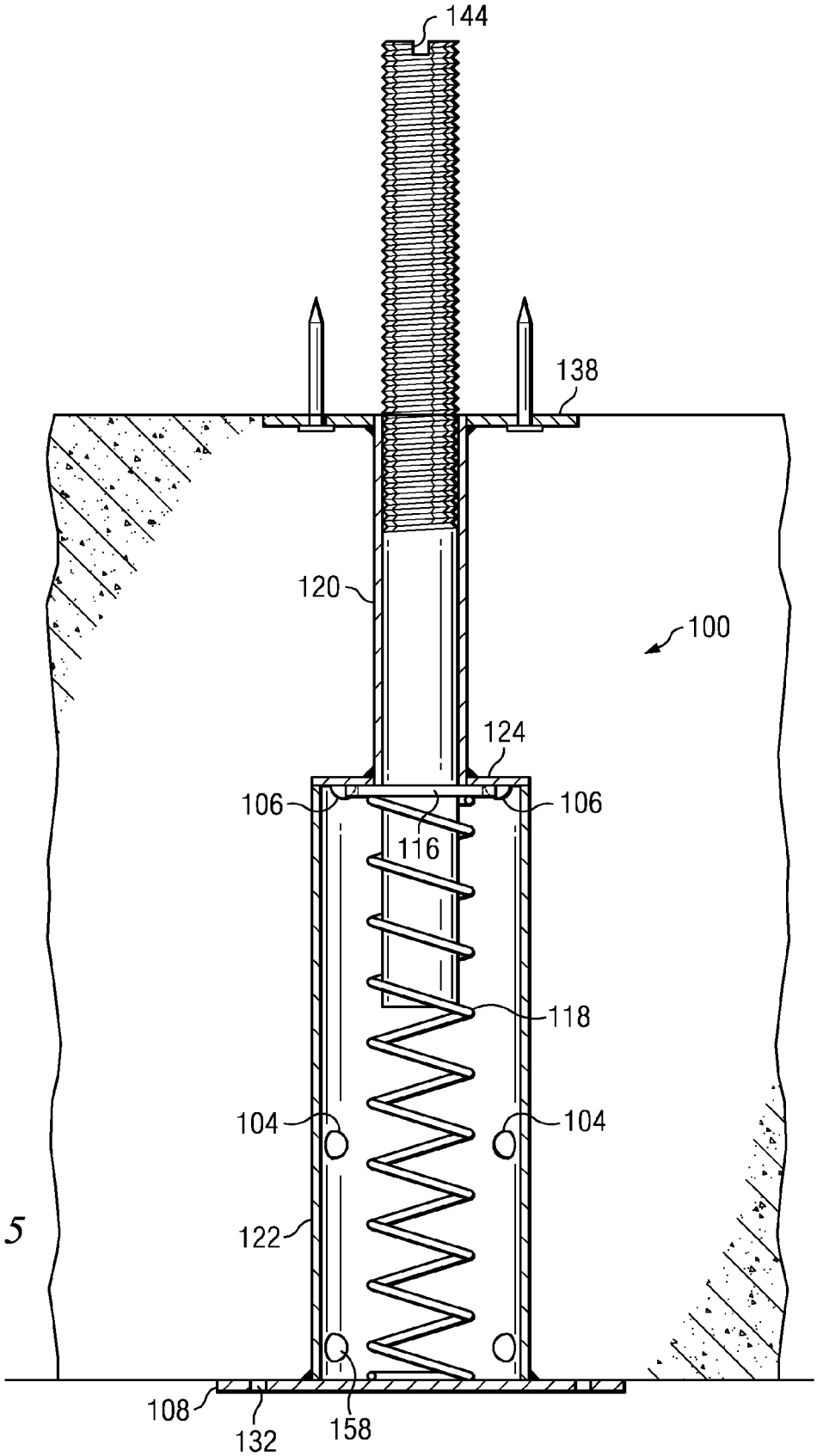
FIG. 5 is a cross sectional view of the spring bolt hanger of FIG. 4 with the bolt in a second, extended state.

FIG. 5 illustrates an embodiment of spring bolt hanger 100 in the second, extended configuration such that the bolt end 126 is extended beyond the end 136 of the rod barrel 120 and is therefore accessible for use as an attachment point. In the extended state, spring 118 is less compressed and biases the retainer 116 against either the junction between the rod barrel 120 and spring barrel 122 or a plate 124 or other structure associated with the junction. As described in detail below, when the bolt is placed in a fully extended configuration, it is advantageous if the retainer 116 engages with the second internal stops 106 to prevent the bolt from rotating when torque is applied to the bolt end 126, for example when a nut is tightened on to the threaded portion of the bolt. The process of transitioning the spring bolt hanger from the retracted to extended configuration is described in detail below.

Figure 4:
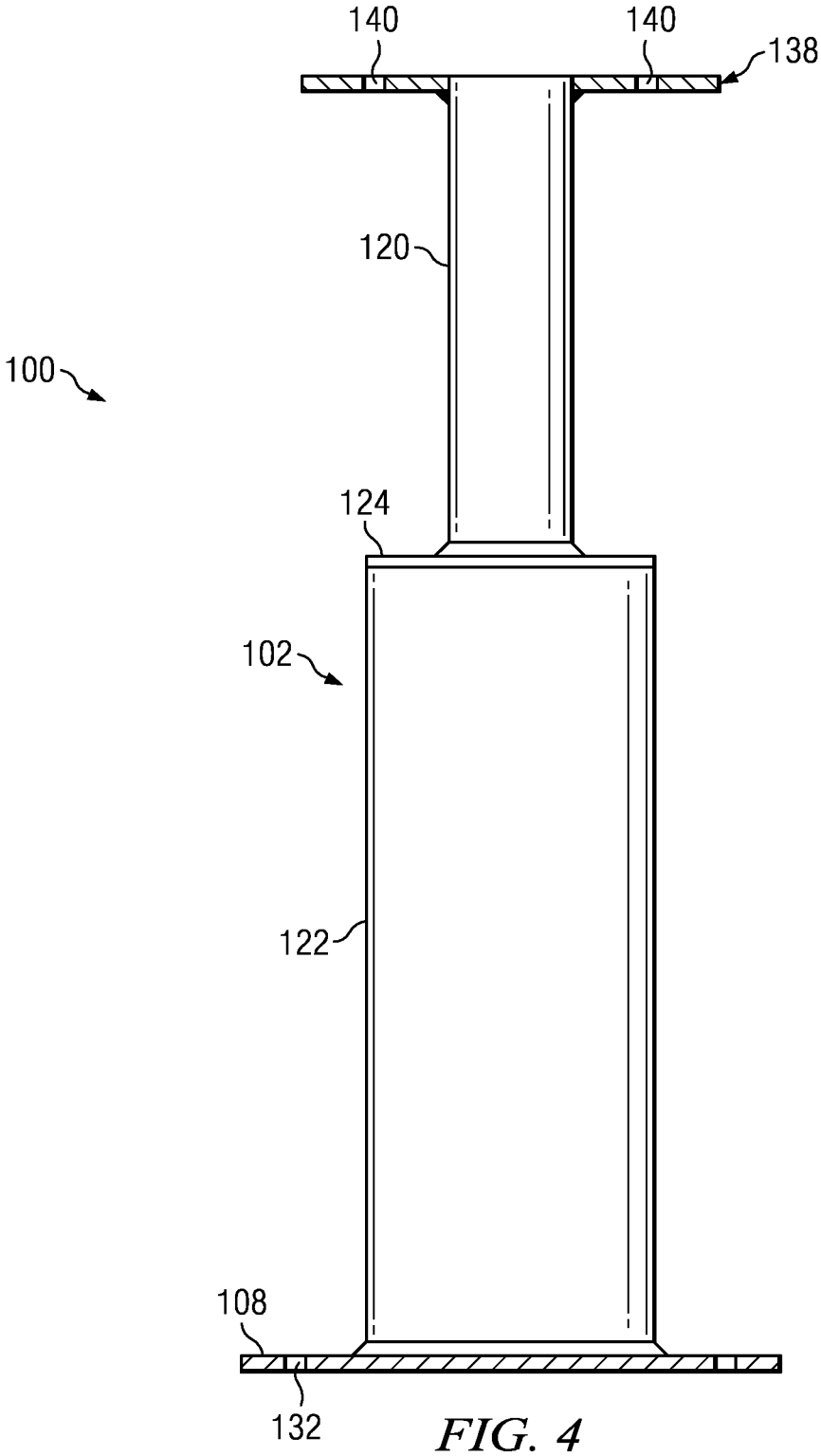
FIG. 4 is a front elevation view of a spring bolt hanger device including a second mounting plate.

With reference to FIGS. 4 and 5, a spring bolt hanger 100 may also be installed in a vertical configuration, such as when embedded within a concrete floor, ceiling or other substantially horizontal structure. The configuration of the spring bolt hanger 100 of FIG. 4 is substantially the same as the spring bolt hanger 100 shown in FIGS. 1-3, except that the FIG. 4 embodiment includes a front plate 138 affixed to the front of the rod barrel 120. This front plate 138 allows the spring bolt hanger 100 to be attached to a front or upper concrete form with screws, nails, adhesives or other attachment devices placed through attachment holes 140.

Figure 6:
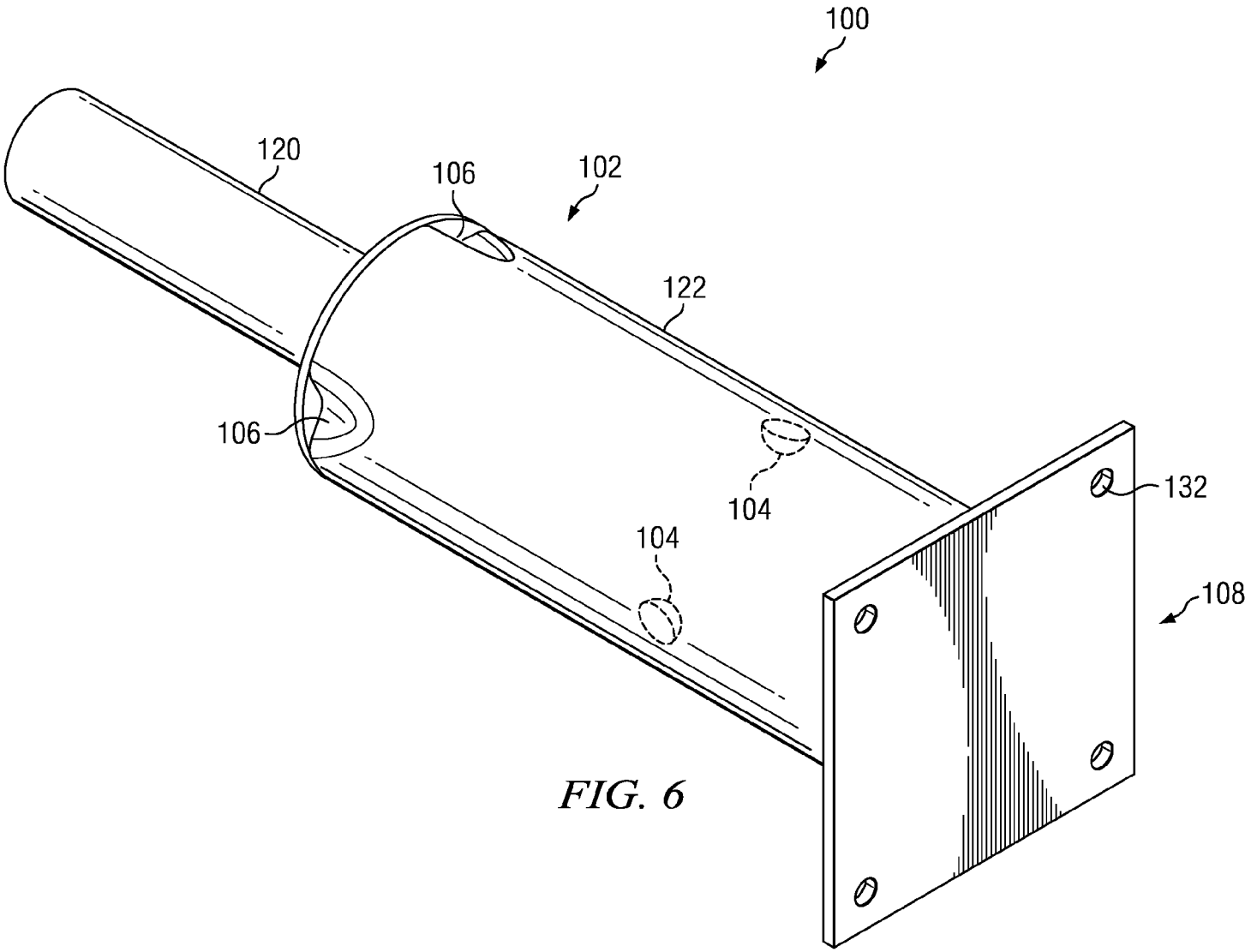
FIG. 6 is a rear perspective view of the spring bolt hanger of FIG. 1 with the bolt in a first, retracted state.

FIG. 6 is a rear perspective view of the spring-bolt hanger 100 of FIG. 1 in the initial, retracted configuration as would typically be selected for installation or when the spring bolt hanger 100 is not actively used as an attachment mechanism. Back plate 108 is shown in FIG. 6 as being substantially square, although back plate 108 could alternatively be implemented with a plate having a round, rectangular or other selected shape.

Figure 7:
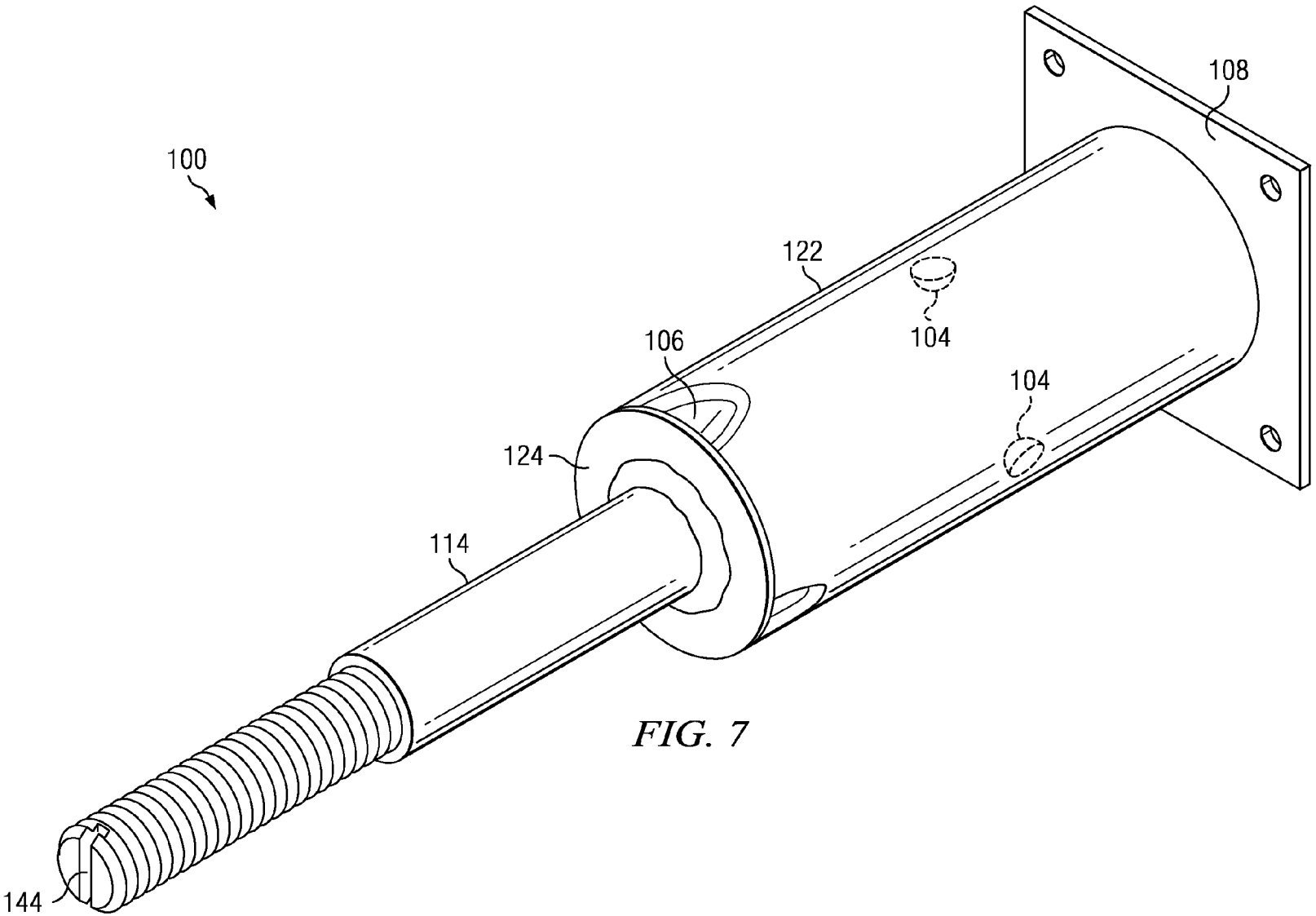
FIG. 7 is a front perspective view of the spring bolt hanger of FIG. 1 with the bolt in the second, extended state.

FIG. 7 is a front perspective view of the spring bolt hanger 100 of FIG. 1. The FIG. 7 view further illustrates the second configuration where the bolt 114 is extended and positioned for use as an attachment point.

Figure 8:
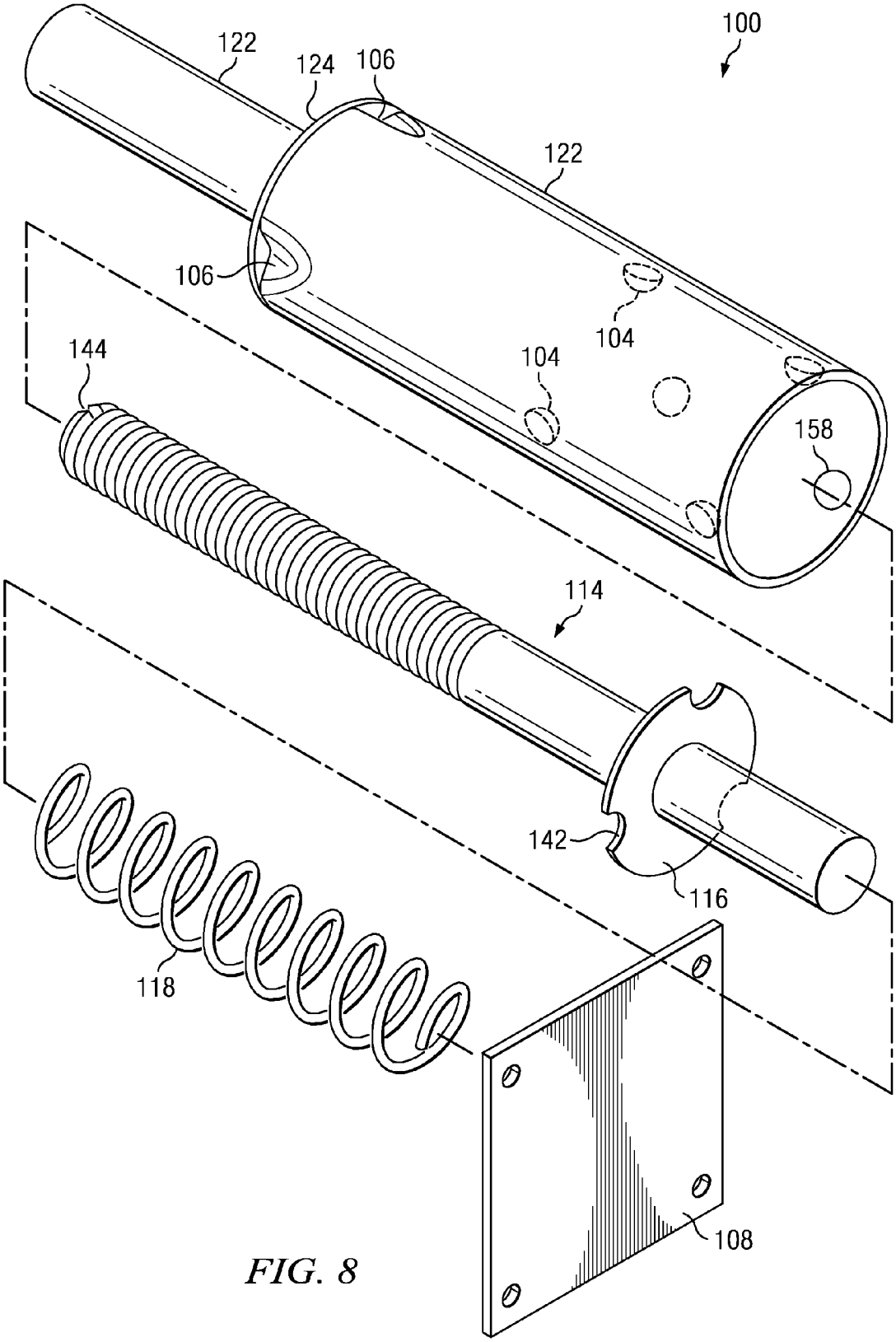
FIG. 8 is an exploded perspective view of selected components of the spring bolt hanger of FIG. 1.

FIG. 8 is an exploded perspective view showing various elements described in detail above. As shown in FIG. 8 and described in detail below, the retainer 116 may have notches or recesses 142 provided along its circumference. In the illustrated embodiment, the recesses 142 are positioned at 120 degree intervals around the circumference of retainer 116. As shown in the embodiment of FIGS. 6-8, internal stops 104 and 106 may also be positioned at 120 degree intervals around the internal circumference of spring barrel 122 so as to be positioned for selective alignment with the notches or recesses 142. As described in detail below, rotation of the bolt end 126 causes rotation of the retainer 116 such that the recesses 142 and the stops may be placed in or out of alignment. Placing the recesses and stops out of alignment will cause the bolt to be held in the retracted position. Placing the recesses and stops into alignment will allow the bolt to extend into an operational position.

The 120 degree interval orientation for both the recesses 142 and stops 104, 106 provides enhanced strength and stability in use, the spring bolt hanger can however be implemented with other recess and stop configurations. In any useable configuration, the retainer 116 may be made to butt up against the first internal stops 104 or slide over the internal stops 104, 106 depending upon the rotational orientation of the retainer 116 with respect to the internal stops 104,106. In most embodiments the number of recesses will equal the number of first internal stops 104, unequal combinations are possible however. This disclosure is not limited to any particular number of recesses 142 and internal stops.

Figure 9A:
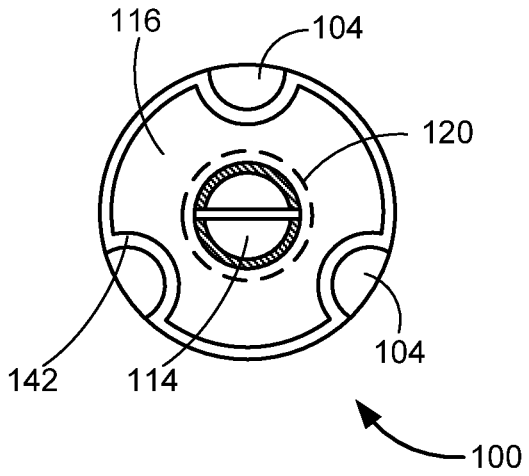
FIG. 9A is a front cross sectional view of the spring bolt hanger of FIG. 1 with the bolt in the second, extended state.

FIG. 9A is a cross sectional front view of the spring bolt hanger 100 of FIGS. 6-8 showing the above described 120 degree configuration, where three recesses 142 are arranged around the outer circumference of retainer 116. The three recesses correspond to three internal stops 104 equally spaced around the inner circumference of spring barrel 122. As noted above, potential embodiments are not limited to any number or positioning of recesses and internal stops.

Figure 9B:
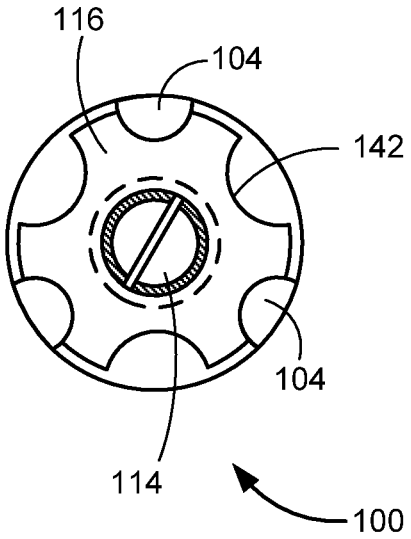
FIG. 9B is a front cross sectional view of the spring bolt hanger of FIG. 1 with the bolt in the first, retracted state.

FIGS. 9A and 9B further illustrate the interaction between the recesses 142 of the retainer 116 and the first internal stops 104. In the configuration illustrated in FIG. 9A, the recesses 142 are in an aligned configuration with the first internal stops 104. This configuration permits the bolt 114 to be extended from the installation/retracted state of FIG. 3 to the extended/use state of FIG. 5. Furthermore, when extended, the recesses 142 engage with the second internal stops 106 to prevent rotation of the bolt 114 when torque is applied to a nut or other fastener threaded on to the bolt.

Alternatively, as shown in FIG. 9B, the bolt 114 and retainer 116 may be rotated such that the recesses 142 do not align with the first internal stops 104. In this configuration, the retainer 116 is biased against the first internal stops 104 by the spring 118. Thus, the front bolt end 126 is secured within the rod barrel 120.

The bolt 114 may be easily moved between the two states illustrated in FIGS. 9A and 9B. For example, in the configuration of FIG. 9A, the bolt 114 may be rotated with a screw driver, allen wrench or other tool that fits into a slot 144, socket, or other receptacle, such that the recesses 142 align with the first internal stops 104. This operation causes the front bolt end 126 to eject beyond the end of the rod barrel 120 as shown in FIGS. 5 and 7. Once the bolt end is ejected beyond the barrel a threaded nut or item may be attached to the spring bolt hanger 100.

Recesses 142 and internal stops 104 and 106 may be of any suitable shape. For example, recesses 142 and the internal stops may have semicircular, trapezoidal, rectangular or other suitable profile. Any suitable combination of retainer and recess shapes is within the scope of this disclosure.

Figure 10:
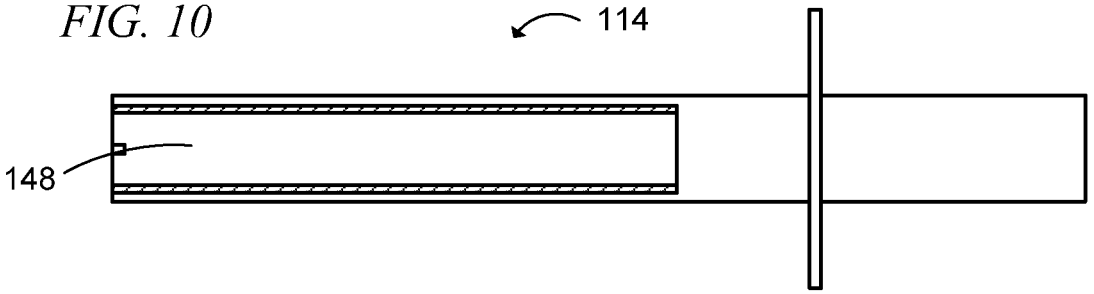
FIG. 10 is a schematic diagram of a bolt having a hollow section and internal threading within the hollow section.
Figure 11:
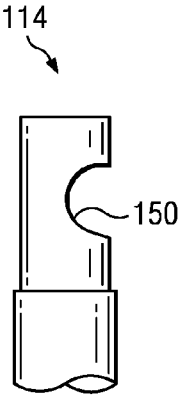
FIG. 11 is a front elevation view of the attachment end of a bolt having a hook.
Figure 12:
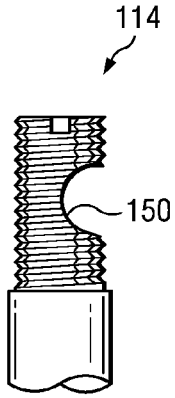
FIG. 12 is a front elevation view of the attachment end of a bolt having threads and a hook.

Bolt 114 as shown in FIGS. 1-9 is implemented with external threading suitable for receiving a nut or other threaded attachment device. The nut may be used to secure a machine, a structural member or any other item that might be attached to a concrete surface. Alternatively, as shown in FIG. 10, the bolt 114 may be provided with internal threading 146 within a hollow cylinder 148. Other attachment ends are possible as well, including but not limited to a hook 150 defined by the bolt 114 as shown in FIG. 11 or a hook 150 and thread combination as shown in FIG. 12. Alternative attachment structures could be included on the bolt 114, for example the bolt could be drilled to receive a pin or ring. Any suitable attachment structure will preferably be easily removable or sized to avoid interference with the ability of the bolt 114 to retract fully into the rod barrel 120 when the spring bolt hanger 100 is being installed or not in use.

Figure 13:
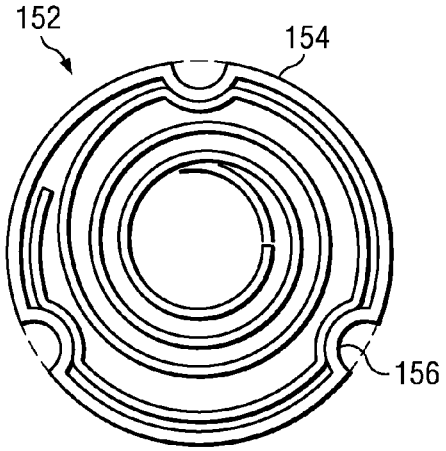
FIG. 13 is a plan view of a cone shaped spring.
Figure 14:
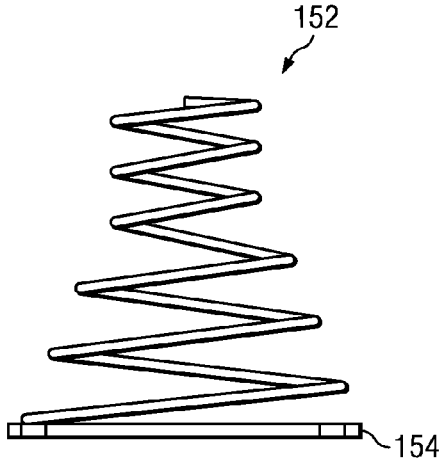
FIG. 14 is a front elevation view of the cone shaped spring of FIG. 13.

FIGS. 1-8 illustrate embodiments implemented with a simple compression spring 118. Certain advantages may be achieved by using an alternative spring configuration. For example, as shown in FIGS. 13 and 14, a spring bolt hanger 100 may be implemented with a cone shaped spring 152 having a wider base end 154. The base end 154 may include a select number of recessed areas 156 which correspond to optional base end retainers 158 as shown in FIGS. 1-3. The base end retainers 158 can be used to retain the spring and thus relieve any spring pressure on the back plate 108. This alternative configuration further allows the back plate to be made of a lighter and perhaps less structurally significant material such as plastic or fiberglass. The use of a cone shaped spring 152 also allows the fully compressed height of the spring to be reduced, potentially minimizing the need for clearance between the first internal stops 104 and the back plate 108.

Figure 15:
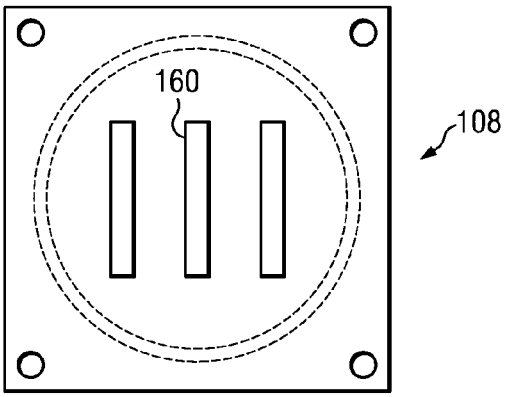
FIG. 15 is a plan view of an optional end plate.
Figure 16:
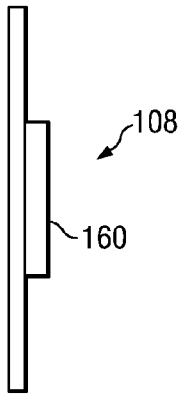
FIG. 16 is a side elevation view of the end plate of FIG. 15

The simple back plate 108 of FIGS. 1-8 may also be implemented in various alternative ways. For example, as noted above, the back plate 108 could be fabricated from a lighter and less expensive material such as plastic, particularly if the back plate does not bear against the spring 118 or 152. In addition, as shown in FIGS. 15-16, the back plate could include two or more ridges 160 or other extensions extending away from the surface of the back plate 108 opposite the spring barrel 122. In use, the outer ridge surface would rest against a concrete form prior to pouring concrete. The wet concrete would then flow over the rear surface of the back plate, in between the ridges. Thus, the rear of the back plate 108 and spring barrel 122 would be encased in concrete and substantially protected from moisture upon removal of the concrete form.

Figure 17:
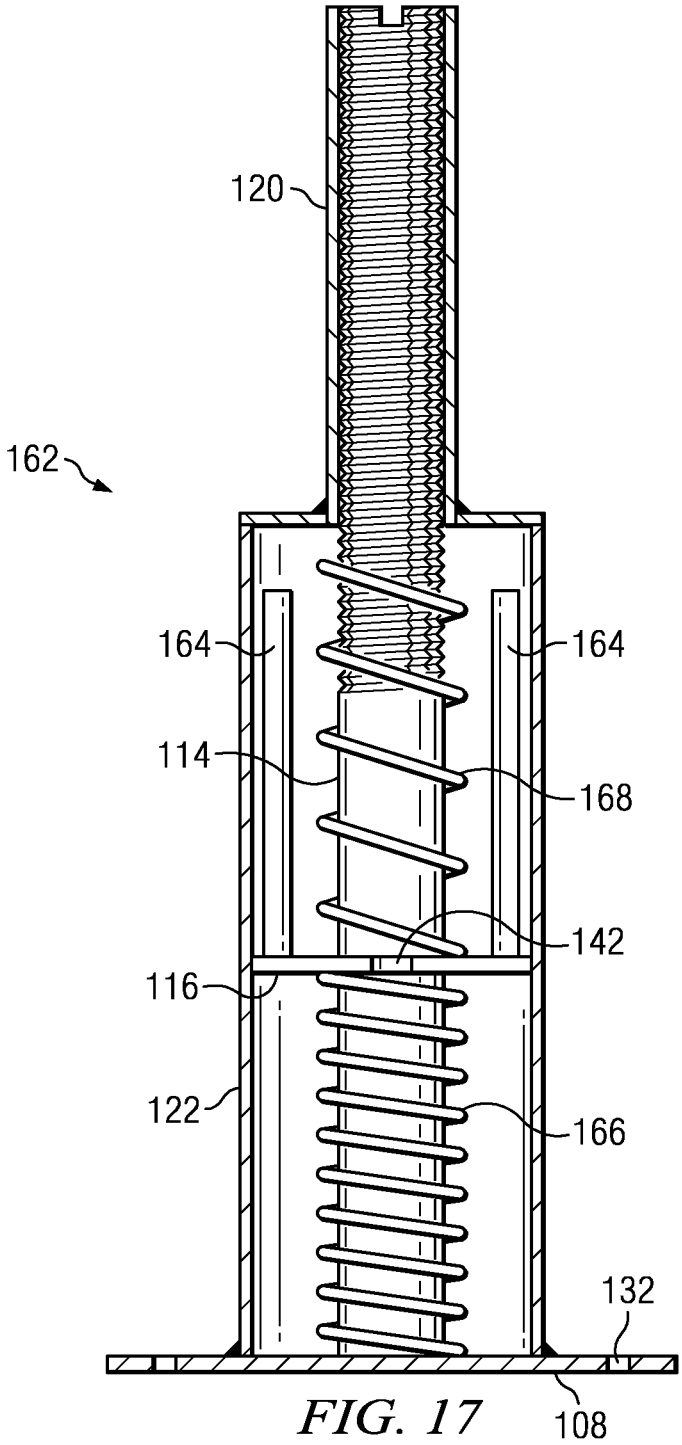
FIG. 17 is a cross sectional view of an anti-vibration embodiment of spring bolt hanger with the bolt in a first, retracted state.
Figure 18:
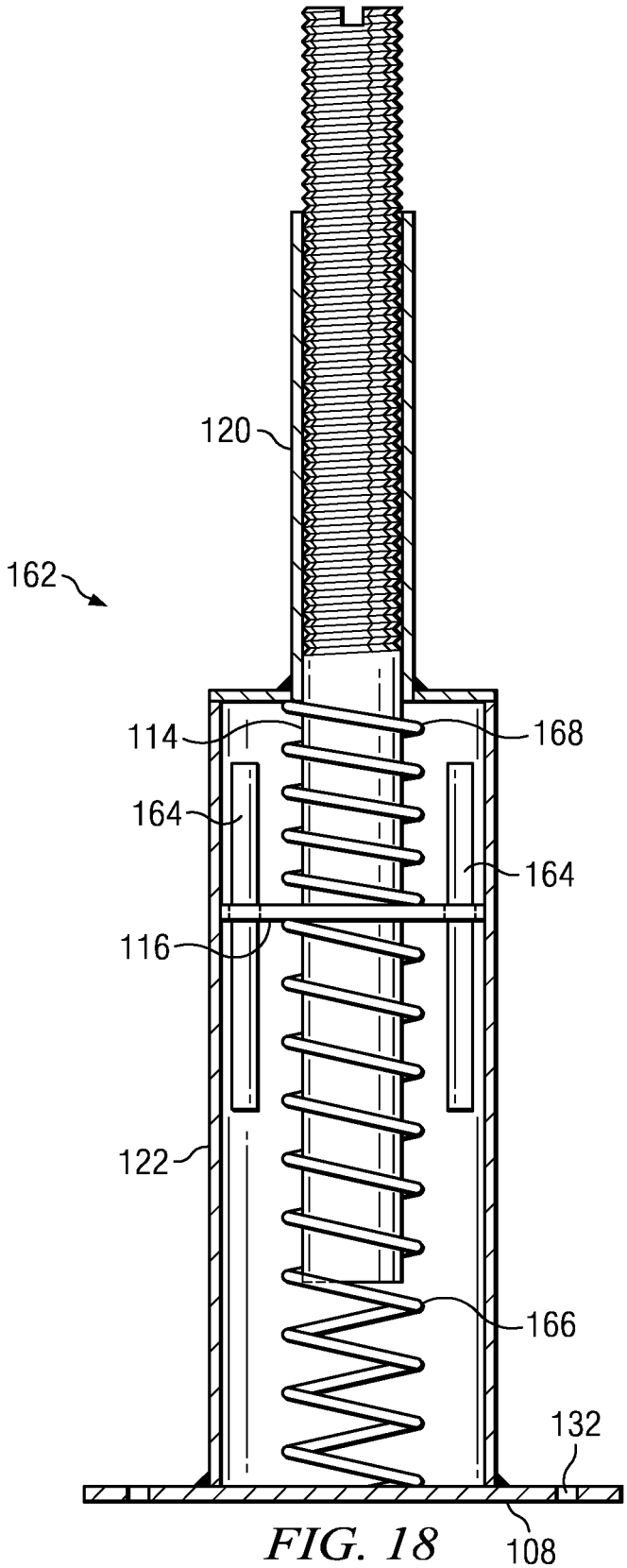
FIG. 18 is a cross sectional view of the anti-vibration embodiment of FIG. 17 with the bolt in a second, extended state.

FIGS. 17 and 18 illustrate an anti-vibration embodiment 162 of spring bolt hanger. The anti-vibration embodiment 162 would be used primarily, but not exclusively in a vertical orientation. The anti-vibration embodiment includes many of the elements described above, including but not limited to a rod barrel 120, spring barrel 122, back plate 108, bolt 114 and retainer 116. The anti-vibration embodiment 162 is shown implemented with two rails 164 spaced 180 degrees apart to fulfill the role of both first and second internal stops as described above.

The anti-vibration embodiment 162 includes two springs. The first spring 166 is a compression spring positioned and configured to operate in the same manner as spring 118 described above. Thus, spring 166 is operatively positioned between the retainer 116 and the back plate 108 (or between the retainer 116 and base end retainers 158, if base end retainers are used). As shown in FIG. 17, spring 166 is substantially compressed when the bolt of the anti-vibration embodiment 162 is retracted for installation. In this configuration, the spring 166 biases the retainer 116 against the rear surface of the rails 164, assuming that the retainer 116 is rotated such that the recesses 142 are not lined up with the rails 164.

The anti-vibration embodiment 162 also includes a second compression spring 168 positioned between the retainer 116 and the junction or plate 124 between the spring barrel 122 and rod barrel 120. As shown in FIG. 18, when the recesses 142 in the retainer 116 are aligned with the rails 164, the retainer and attached bolt 114 are free to move away from the back plate 108. Thus, the bolt end 126 is made to extend from the rod barrel 120 in an operative manner. Providing a first spring 166 which has at least a slightly greater spring constant that the second spring 168 will facilitate the initial ejection of the bolt 114 from the barrel. In the anti-vibration embodiment, any movement of the bolt 114 from the retracted state causes the retainer 116 to compress the second spring 168. A nut or other fastener threaded on to the bolt end 126 and tightened will therefore progressively compress the second spring 168.

The anti-vibration embodiment 162 is well suited to high vibration environments, for example the attachment of a machine to a concrete floor. The unique configuration of spring 168 causes the tension placed on the machine mounting to be selectable, since additional turns of a nut engaged with the machine will apply additional compression to spring 168. Furthermore, when the attached machine vibrates during operation, the springs 166 and 168 cooperate to absorb some of such vibration. As with all embodiments disclosed herein, the size of the spring bolt hanger and elements such as the springs located therein can be scaled to suit any intended purpose.

Multiple spring bolt hangers 100 may be embedded within a single concrete wall, floor, ceiling, slanted ceiling, column, posts, ramp, and/or other concrete surface. The spring bolt hangers 100 may be arranged in any configuration that is necessary to achieve a desired attachment pattern.

Figure 19:
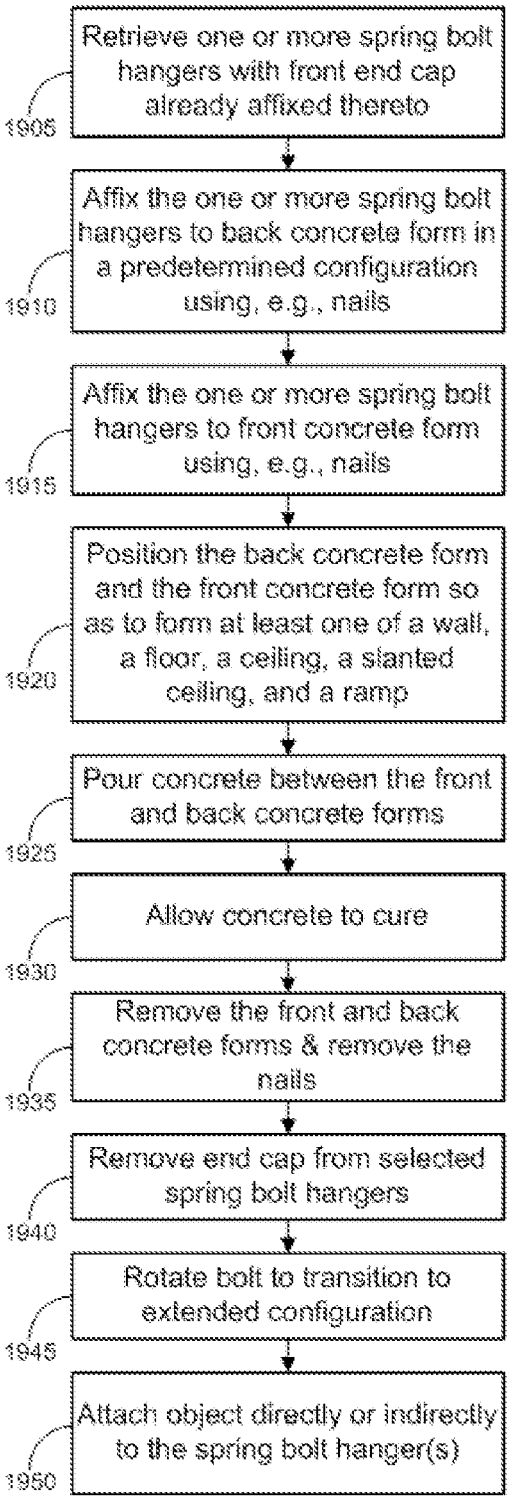
FIG. 19 is a flowchart illustrating representative method steps for installing and using a spring bolt hanger.

FIG. 19 is a flowchart showing one possible manner of spring bolt hanger installation and use. Some steps of FIG. 19 may be executed in a different order. Some steps of FIG. 19 are optional. With reference to FIG. 19, use of a spring bolt hanger may commence by obtaining one or more spring bolt hangers 100, with front end caps 110 affixed to the open end of the rod barrel 120 to seal the interior of the rod barrel from wet concrete in subsequent steps (Step 1905). The spring bolt hangers 100 are then attached to a concrete form 128, using nails 112 or other attachment devices placed through holes 132 in back plate 108 (Step 1910). As an optional step, the spring bolt hangers 100 may be attached to a front concrete form, using nails or other attachment means through holes in a front plate 138 (Step 1915). In some embodiments, such as when used with a concrete structure that is deeper than the length of the spring bolt hanger, the spring bolt hanger may be affixed by only the front plate 138. Next, the front and back concrete forms (with the attached spring bolt hangers) are positioned and arranged so as to define a pouring form for at least one concrete structure, including but not limited to a wall, floor, ceiling, slanted ceiling, column, post, ramp, or other concrete structure having a surface (Step 1920). Step 1920 may be implemented before or as part of Steps 1910 and 1915. In addition a spring bolt hanger could be implemented with a more complex, typically re-usable concrete mold or form, such as might be used to fabricate a pre-stressed concrete structure of any type, concrete tanks, conduits, buildings or other more or less complex structures.

In Step 1925, uncured concrete is poured between or within the concrete forms so as to embed the spring bolt hangers 100 and form a concrete structure. After the concrete has cured sufficiently, the concrete forms are removed (Steps 1930 and 1935). Any nails used to secure the spring bolt hanger will pull out of the forms and may also be removed from the spring bolt hanger by cutting the nails with a saw or grinder.

The front end cap 110 of each selected spring bolt hanger 100 may be removed in Step 1940. At Step 1945, a screw driver or other tool may be used to rotate both the bolt 114 and retainer 116 to transition the bolt 114 from the retracted configuration to an extended configuration, as discussed above. In the extended configuration, the spring bolt hanger 100 is configured for use. An object or structure may be attached to the spring bolt hanger in any suitable manner (Step 1950).

Figure 20:
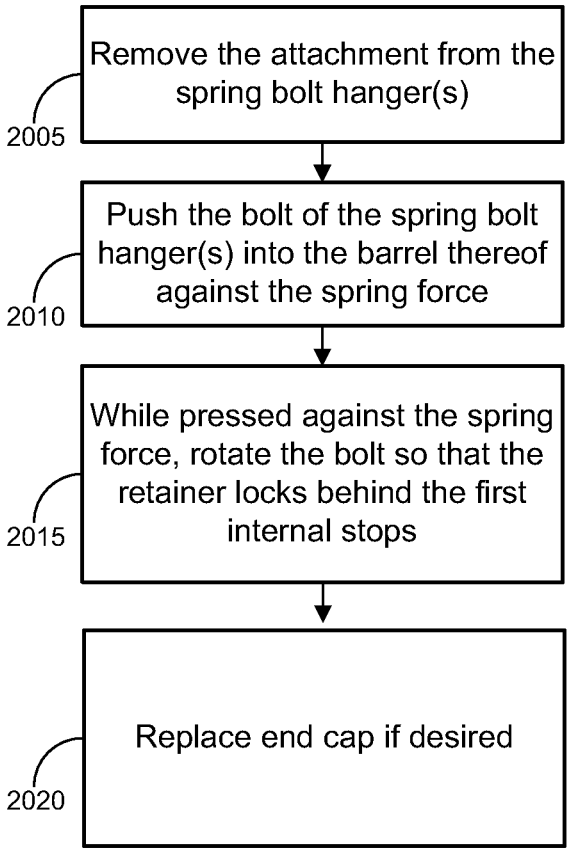
FIG. 20 is a flowchart illustrating representative method steps for resetting a spring bolt hanger 100 when no longer in active use.

With reference to FIG. 20, a selected spring bolt hanger 100 which is no longer required for active attachment may be reset into the concrete surface. In particular, Step 2005 includes removing any nut or other element attached to the bolt 114. In Step 2010, the bolt 114 is pushed against spring 118 into the barrel 102 compressing the spring 118. While pressed against the compressed spring 118, the bolt 114 is rotated so that the retainer 116 locks behind the first internal stops 104 (Step 1615). Thus, the bolt is safely stored within the concrete structure ready for subsequent extension and use. The open end of the spring bolt hanger may optionally be covered with an end cap.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

While the embodiments disclosed herein have been particularly shown and described with reference to a number of alternatives, it would be understood by those skilled in the art that changes in the form and details may be made to the various specifically described embodiments without departing from the spirit and scope of the invention and that the various embodiments disclosed herein are not intended to act as limitations on the scope of the claims. All references cited herein are incorporated in their entirety by reference.

What is claimed is:

1. A spring bolt hanger comprising:

a barrel comprising a rod barrel section and a spring barrel section, wherein the rod barrel section has a diameter smaller than a diameter of the spring barrel section, wherein the rod barrel section is permanently fixed with respect to the spring barrel section and wherein the spring barrel section is permanently fixed with respect to the rod barrel section;

a bolt positioned within the barrel;

a retainer associated with the bolt; and a spring positioned in the barrel between the retainer and a first end of the barrel, said spring configured to bias the bolt away from the first end of the barrel, wherein the retainer, the plurality of first internal stops, and the spring are positioned in the spring barrel section.

2. The spring bolt hanger of claim 1 wherein the retainer is a circular retainer.

3. The spring bolt hanger of claim 1 further comprising a plurality of first internal stops disposed on an inner surface of the barrel; wherein the spring is configured to bias the retainer against the plurality of first internal stops when the bolt is positioned in a refracted state.

4. The spring bolt hanger of claim 1, wherein when the bolt is positioned in the retracted state, the bolt is retracted within the barrel, and when the bolt is positioned an extended state, an exposed end of the bolt extends beyond the barrel.

5. The spring bolt hanger of claim 1, wherein the retainer includes a plurality of recesses corresponding to the position of the plurality of first internal stops, wherein the bolt is configured to be moved from the retracted state to the extended state by rotation of the bolt such that the plurality of recesses align with the plurality of first internal stops.

6. The spring bolt hanger of claim 5 wherein the retainer includes three recesses spaced around the circumference of the retainer at 120 degree intervals.

7. The spring bolt hanger of claim 5, wherein the exposed end of the bolt includes a receptacle configured to mate with a tool to provide for manual rotation of the bolt.

8. The spring bolt hanger of claim 5, further comprising a plurality of second internal stops disposed in the spring barrel section, said plurality of second internal stops being configured to prevent rotation of the bolt by interlocking with the plurality of recesses of the retainer when the bolt is in the extended state.

9. The spring bolt hanger of claim 8 wherein the plurality of second internal stops are axially aligned with the plurality of first internal stops.

10. The spring bolt hanger of claim 9 wherein at least one of the plurality of first internal stops and the corresponding at least one of the plurality of second internal stops are defined by opposite ends of a single retainer rail.

11. The spring bolt hanger of claim 1 further comprising a plate attached to an end of the barrel providing for the spring bolt hanger to be affixed to a concrete form.

12. A method of attaching an object to a concrete surface comprising:

providing a spring bolt hanger comprising:

a barrel comprising a rod barrel section and a spring barrel section, wherein the rod barrel section has a diameter smaller than a diameter of the spring barrel section, wherein the rod barrel section is permanently fixed with respect to the spring barrel section and wherein the spring barrel section is permanently fixed with respect to the rod barrel section;

a bolt positioned within the barrel;

a retainer associated with the bolt; and a spring positioned in the barrel between the retainer and a first end of the barrel, said spring configured to bias the bolt away from the first end of the barrel such that an end of the bolt may extend beyond an opposite end of the barrel wherein the retainer, the plurality of first internal stops, and the spring are positioned in the spring barrel section;

embedding the spring bolt hanger in concrete;

extending the bolt to an extended state where the end of the bolt extends beyond the barrel; and attaching the object to the extended end of the bolt.

13. The method of claim 12 wherein the provided spring bolt hanger further comprises an attachment plate, the method further comprising:

attaching the spring bolt hanger to a concrete form with the attachment plate; and pouring fluid concrete into a space defined in part by the concrete form thus embedding the spring bolt hanger in concrete.

14. The method of claim 12, wherein the barrel of the provided spring bolt hanger further comprises a rod barrel section and a spring barrel section, wherein the rod barrel section has a diameter smaller than a diameter of the spring barrel section, and wherein the retainer, the plurality of first internal stops, and the spring are positioned in the spring barrel section.

15. The method of claim 14, wherein the retainer includes a plurality of recesses corresponding to the position of the plurality of first internal stops, the method further comprising moving the bolt from the refracted state to the extended state by rotation of the bolt such that the plurality of recesses align with the plurality of first internal stops.

16. The method of claim 15, wherein the exposed end of the bolt includes a receptacle configured to mate with a tool in order to provide for manual rotation of the bolt.

17. The method of claim 14, wherein the provided spring bolt hanger further comprises a plurality of second internal stops disposed in the spring barrel section, said plurality of second internal stops being configured to prevent rotation of the bolt by interlocking with the plurality of recesses of the retainer when the bolt is in the extended state.

18. The method of claim 14, further comprising:

removing the object from the first end of the bolt;

pushing the bolt into the barrel, thus compressing the spring with the retainer; and rotating the bolt such that the retainer is retained in position between the plurality of first internal stops and the spring.

* * * * *